US005490578A

United States Patent [19]

Aulanko et al.

[11] Patent Number: 5,490,578

[45] Date of Patent: Feb. 13, 1996

[54] STRUCTURE FOR ATTACHING ELEVATOR MACHINERY IN A BUILDING

[75] Inventors: Esko Aulanko, Kerava; Jorma Mustalahti; Harri Hakala, both of Hyvinkää, all of Finland

[73] Assignee: Kone Oy, Helsinki, Finland

[21] Appl. No.: 266,181

[22] Filed: Jun. 27, 1994

[30] Foreign Application Priority Data

| | | | |
|---|---|---|---|
| Jun. 28, 1993 | [FI] | Finland | 932977 |
| May 25, 1994 | [FI] | Finland | 942432 |

[51] Int. Cl.[6] ..... B66B 11/08

[52] U.S. Cl. ..... 187/254; 187/266; 187/414

[58] Field of Search ..... 187/251, 254, 187/266, 289, 414

[56] References Cited

U.S. PATENT DOCUMENTS

| | | | |
|---|---|---|---|
| 203,782 | 5/1878 | Schmidt | 187/266 |
| 5,018,603 | 5/1991 | Ito | 187/254 |
| 5,035,300 | 7/1991 | Chapelain et al. | 187/266 |
| 5,226,508 | 7/1993 | Ericson et al. | 187/254 |

FOREIGN PATENT DOCUMENTS

| | | | |
|---|---|---|---|
| 82170 | 2/1957 | Denmark | 187/251 X |
| 371806 | 6/1990 | European Pat. Off. . | |
| 1338648 | of 1963 | France . | |
| 1032496 | 6/1958 | Germany . | |
| 1033383 | 7/1958 | Germany . | |
| 3818856 | 12/1989 | Germany . | |
| 395091 | 4/1991 | Japan | 187/254 X |
| 436619 | 11/1967 | Switzerland . | |
| 954319 | 4/1964 | United Kingdom . | |
| 2138397 | 10/1984 | United Kingdom | 187/254 X |
| WO8702344 | 4/1987 | WIPO | 187/254 X |

*Primary Examiner*—William E. Terrell
*Assistant Examiner*—Dean A. Reichard

[57] ABSTRACT

Elevator machinery is fastened by its top part to a mounting beam. The mounting beam is fixed in place to side walls of an elevator shaft. The elevator machinery includes a motor, a disc brake and a transaction sheave. The beam, on which the elevator machinery is mounted, is laid in a plane perpendicular to the axis of rotation of the machinery.

8 Claims, 2 Drawing Sheets

STRUCTURE FOR ATTACHING ELEVATOR MACHINERY IN A BUILDING

TECHNICAL FIELD

The present invention relates to an arrangement for attaching elevator machinery to a building.

Traditionally, an elevator machinery is attached to a building by using a base located mainly under the elevator machinery in other words, the machinery stands on its base. This means that the center of gravity and the point of application of the rope forces are located above the supporting points of the elevator machinery. A drawback with such a design is that the machinery is prone to various rocking vibrations. To overcome these, the points by which the base is supported on the building structures have to be placed as far apart as possible, which again requires floor space and increases costs. To prevent rocking, a conventional base has to be fairly rigid in construction. Such a base structure normally has four supporting points, one at each corner.

SUMMARY OF THE INVENTION

To solve the above-mentioned rocking problem, an arrangement for fixing an elevator machinery to a building is presented as an invention.

The advantages which can be achieved by applying the present invention include the following:

- A simple and cheap solution for fixing the machinery to the building structures is achieved.
- The center of gravity of the machinery and the point of application of the rope forces are located below the supporting points of the machinery.
- The combined effect of the weight of the machinery and the rope forces can be easily adjusted with respect to the supporting points of the machinery so that lateral vibrations are in principle eliminated although the points of support of the machinery are not far apart in the lateral direction.
- The system of the invention for fixing the machinery to a building is especially applicable in elevator machinery solutions where the machinery is of a flat construction in the direction of the shaft of the traction sheave of the elevator.
- The system of the invention for fixing the machinery to a building is especially applicable in elevator machinery solutions where the machinery is placed in the elevator shaft.

In Finnish patent application no. 932977, reference is made to elevator machinery solutions in which the elevator machinery is of a flat construction in the direction of the shaft of the traction sheave of the elevator. A flat construction of the machinery allows the elevator machinery to be fairly easily placed in an elevator shaft by using a mounting beam located in the top part of the elevator shaft. The mounting beam may be implemented as a part of the frame structure of the machinery unit, thus constituting a "mounting bracket" by which the machinery unit is fixed to the walls or ceiling of the elevator shaft.

BRIEF DESCRIPTION OF THE DRAWINGS

In the following, the present invention is described in detail by the aid of some examples of its embodiments by referring to the attached drawings, in which.

Figure 1:
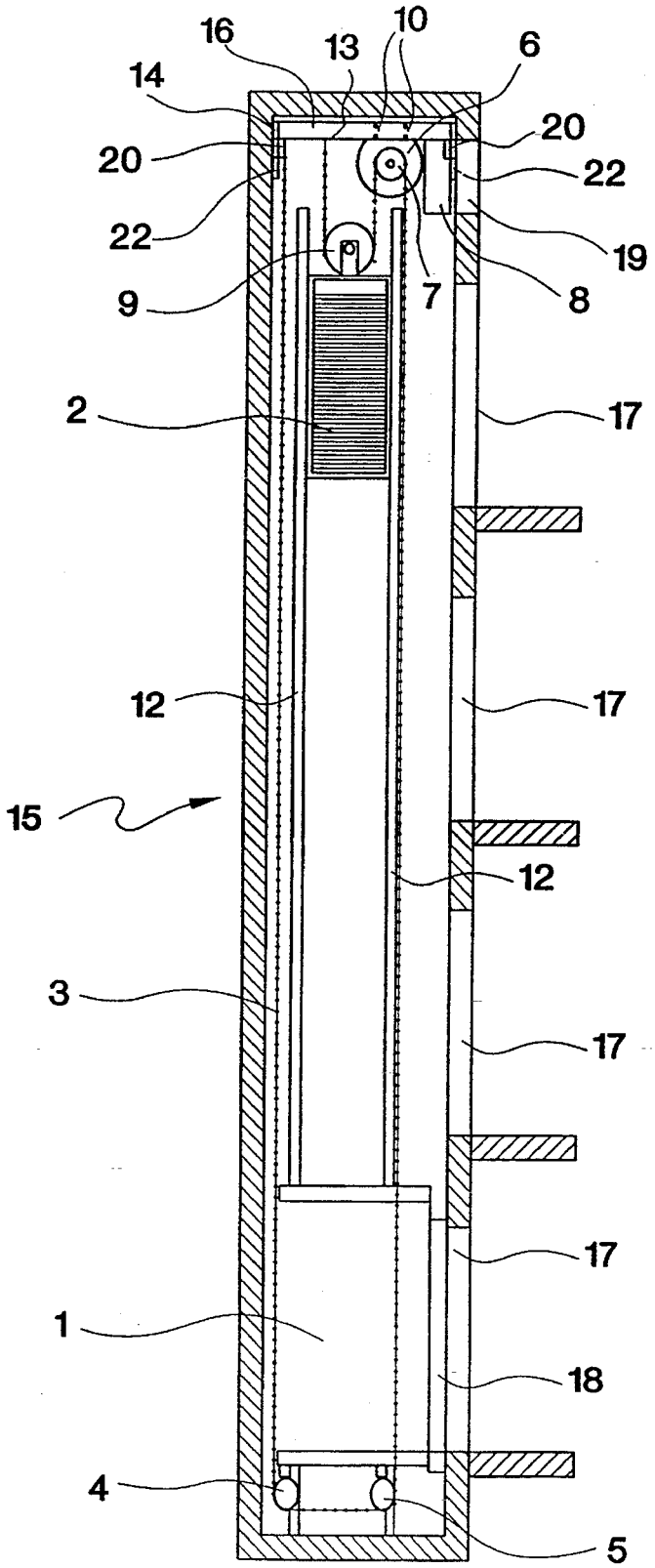
FIG. 1 is a diagram illustrating an elevator implemented by applying the invention.

The diagram in FIG. 1 represents an elevator implemented according to the invention, placed in an elevator shaft 15 and seen from one side. The elevator car 1 and counterweight 2 are suspended on guide rail units 12 containing guide rails for both the elevator car and the counterweight and on hoisting ropes 3 (shown here with broken lines). The guides of the elevator car and counterweight are not shown in the figure. Placed in the top part of the elevator shaft 15 is a mounting beam 16, to which the elevator machinery 6, provided with a traction sheave 7, is fixed. The same beam 16 can serve as a mounting base for the equipment required for the supply of power to the motor and for an instrument panel 8 containing the equipment needed for the control of the elevator. The function of the mounting beam 16 is to transmit the weight of the machinery 6 and that part of the weights of the counterweight 2, ropes 3 and elevator car 1 which is received by the beam to a suitable supporting structure in the building, such as a wall of the elevator shaft 15. The beam 16 is attached to the building structure by its fixing points 22, which are suitably implemented as brackets fixed to a wall or the ceiling.

To prevent vibrations that may arise in the machinery from being transmitted via the beam to the structures of the building, it is possible to use e.g. rubber insulators 20, which are preferably placed between the beam 16 and the brackets 22. Other places possible for the vibration insulators are for example, the joint between the machinery and the beam or, in a multi-layer beam structure, between different structural layers of the beam.

The mounting beam may be made of several parts in the lengthwise direction as well. The parts of the beam may be partially inside each other or overlapping. The mounting beam 16 can be fabricated by fixing the machine unit 6 and control panel 8 to it at the factory, or the mounting beam can be implemented as part of the frame structure of the machinery, thus forming a 'bracket' for fixing the machine unit 6 to the wall or ceiling of the shaft 15. The beam 16 is also provided with a point of attachment 13 for at least one end of the hoisting ropes 3. The other end of the hoisting ropes is often fixed to a point of attachment 14 located in a place other than the mounting beam 16.

Figure 2:
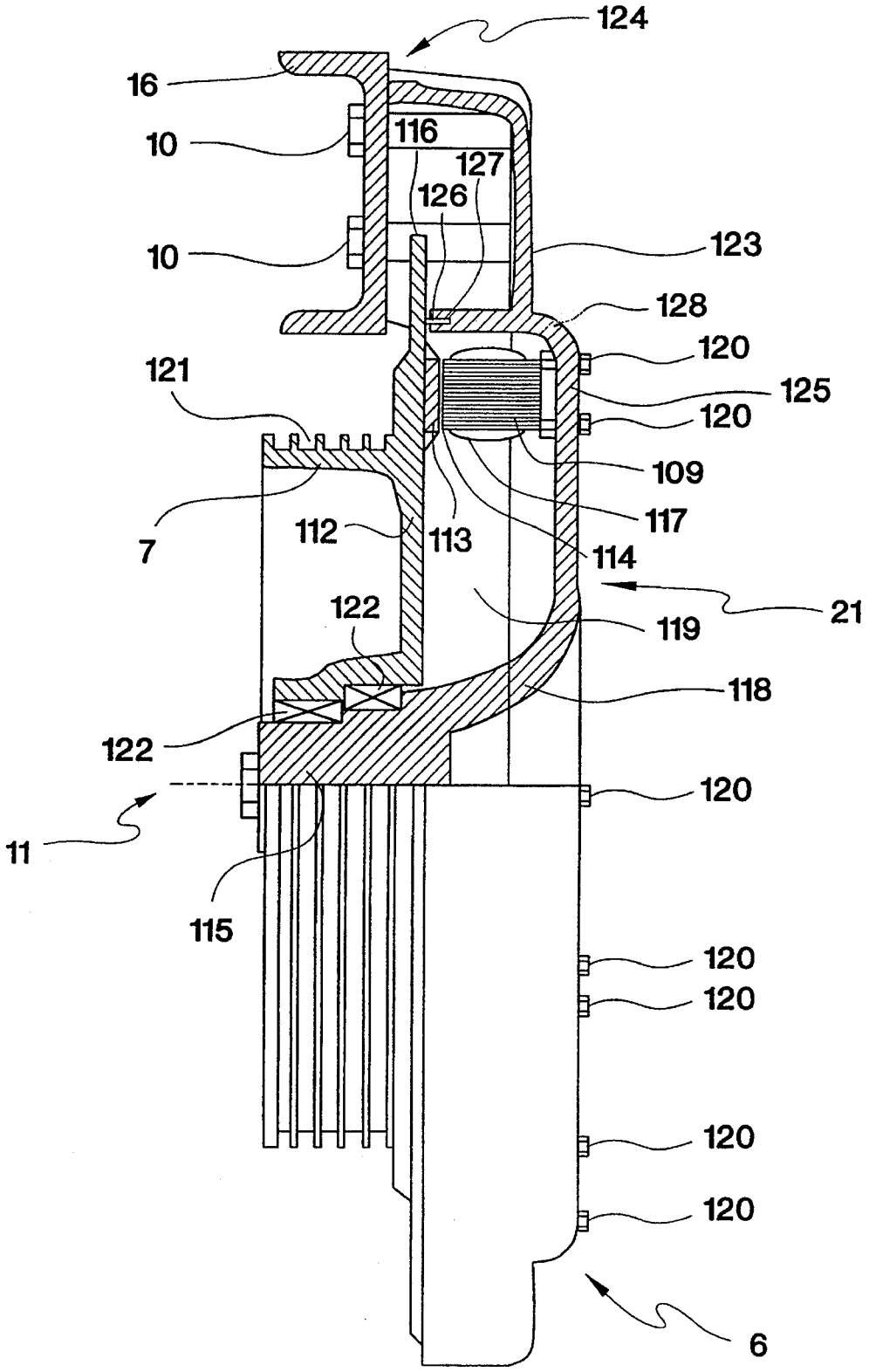
FIG. 2 is an illustration of an elevator machinery fixed to a mounting beam and partially sectioned.

The elevator shaft 15 is provided with a landing door 17 for each floor, and the elevator car 1 has a car door 18 on the side facing the landing doors. On the topmost floor there is a service hatch 19 opening into the shaft space and so placed that a serviceman can reach the control panel 8 and the machinery 6 through the hatch, if not from the floor then at least from a working platform placed at some height above the landing floor. A service hatch 19 is so placed and dimensioned that the operations for which it is intended, for example emergency operation, can be performed with sufficient ease via the hatch. Ordinary service operations on the machinery 6 and control panel 8 can be performed while standing on the top of the elevator car 1. Diverting pulleys 4,5 are used to suspend the elevator car 1 and diverting pulley 9 to suspend the counterweight 2 on the hoisting ropes 3. FIG. 2 illustrates an elevator machinery 6 fixed to the mounting beam 16, showing the machinery as sectioned along a plane starting upwards from the axis 11 of rotation in the direction of the radius of the shaft 11. The machinery 6 comprises a motor 21, a disc brake and a traction sheave 7. In FIG. 2, the machinery is enlarged in the dimension corresponding to the lengthwise direction of the motor shaft to render the figure more readable. In reality, the machinery is flat in the axial direction. The beam 16 is preferably laid in a direction corresponding to the direction of a plane perpendicular to the axis of rotation of the machinery 6 and therefore of the traction sheave 7, so the beam need not be designed to withstand a very large torsional force but primarily only vertical forces applied to it by the weight and as a result of the acceleration and deceleration of the elevator. This applies especially when the vertical forces can be transmitted via a point on or near the neutral axis of the beam.

The motor 21 has a rotor 113 mounted in a rotor disc 112 and a stator 109 mounted in a stator disc 118. The rotor of this motor is composed of permanent magnets. The rotor and stator are separated by an air gap 114 which lies in a plane essentially perpendicular to the shaft 115 of the motor 21. The stator together with its winding 117 is a ringlike structure which is placed in a ringlike cavity 119 in the stator disc 118, said cavity being open on one side. The stator is fixed by means of fixing elements, preferably screws, to that wall 125 of the cavity 119 which is perpendicular to the shaft 115. However, the stator can be fixed to any one of the walls of the cavity. The cavity 119 consists of a ringlike trough provided in the stator disc and having its open side towards the rotor disc 112, leaving a ringlike space between the stator disc and the rotor disc. Attached to the rotor disc 112 is a ringlike brake disc 116 placed on the circumference of the rotor disc 112 as an extension of the latter in its radial direction. The ringlike brake disc can be integrated with the rotor disc so as to form a single body. The disc brake (not shown in the figures) is so mounted that it can float in the lengthwise direction of the shaft 115, with fixing elements placed on either side of the brake disc 116.

Attached to the rotor disc 112 is a cylindrical rope sheave 7 provided with rope grooves 121. The diameter of the rope sheave is smaller than that of the circle formed by the rotor bars 113 in the rotor disc and the stator 109 in the stator disc 118. The rotor disc 112, rope sheave 7 and brake disc 116 are integrated as a single part. The brake disc is therefore substantially an immediate extension of the rotor disc, yet so that a narrow circular area for a sealing is provided between the rotor bars and the brake disc.

The stator disc 118 and the shaft 115 are also integrated as a single body, which simultaneously acts as the frame of the elevator machinery. The assembly consisting of the stator disc 118 and the shaft 115 is preferably made of a casting provided with a bracket 123. Bearings 122 are provided between the rotor disc and the stator disc. Between the rotor disc and the stator disc there is also a ringlike seal 126 placed so that its stop face in the rotor disc lies between the rotor bars and the brake disc. The seal 126 seals off the cavity 119, rendering it a closed space and thus blocking the access of dust into the space. The area of adhesion 127 required for the attachment of the seal is implemented as a slot in the axially oriented wall of the cavity in the rotor disc. The seal may be e.g. a felt gasket.

The bracket 123 projects from the frame of the elevator machinery 6. Several brackets may be provided. The bracket 123 has a front surface 124 which is placed against the beam 16. The front surface 124 may continue from the bracket 123 to another part of the frame. The elevator machinery is fixed to the beam 16 by the bracket 123 by means of fixing elements 10, preferably screws. The backet may be machined into a suitable shape to fit the mounting beam, producing e.g. a set-off which rests on a horizontal surface of the horizontal mounting beam. In a preferable embodiment the elevator machinery 6 is fixed to the beam 16 by a point in the top part of the machinery, so the centre of gravity and the point of application of the rope forces can easily be placed below the supporting points of the elevator machinery. A preferable place for the machinery and beam is in the shaft space above the counterweight.

It is obvious to a person skilled in the art that different embodiments of the invention are not restricted to the examples described above, but that they may instead be varied within the scope of the claims presented below. For instance, the mounting beam to which the machinery is fixed may consist of a box beam, a U-section or I-section beam or some other suitable type of supporting beam, which is attached for example by its ends to a suitable structure in the building, for example the walls or ceiling of the shaft.

It is also obvious to the skilled person that application of the invention is not restricted to the type of elevator presented in Finnish patent application no. 932977. It is further obvious to the skilled person that, according to the invention, the elevator machinery can be placed in a machine room above the elevator shaft.

We claim:

1. An apparatus attaching elevator machinery to an elevator shaft comprising:

an elevator shaft;

a mounting beam having two ends with each end solely fixed to opposite side walls of the elevator shaft and at a top portion of the elevator shaft; and elevator machinery including a motor, having a top portion, which top portion is directly attached to the mounting beam.

2. The apparatus according to claim 1, wherein a frame of the elevator machinery is provided with at least one mounting bracket by which the elevator machinery is fastened to the mounting beam.

3. The apparatus according to claim 2, wherein the mounting bracket projects from a the frame of the elevator machinery and that the bracket has a front surface which is placed against the mounting beam.

4. The apparatus according to claim 1 wherein the elevator machinery has an axis of rotation and is flat in the direction of the axis of rotation.

5. The apparatus according to claim 1, characterized in that the mounting beam is laid in a substantially horizontal direction.

6. The apparatus according to claim 1, wherein the mounting beam is laid substantially in the direction of a plane perpendicular to an axis of rotation of a traction sheave of the elevator machinery.

7. The apparatus according to claim 1, wherein the mounting beam is provided with at least one vibration insulator.

8. The apparatus according to claim 1, wherein the elevator machinery is suspended in the elevator shaft.

* * * * *